US009097106B2

(12) United States Patent
Dussan V et al.

(10) Patent No.: US 9,097,106 B2
(45) Date of Patent: Aug. 4, 2015

(54) APPARATUS, METHOD AND SYSTEM FOR MEASURING FORMATION PRESSURE AND MOBILITY

(75) Inventors: Elizabeth B. Dussan V, Cambridge, MA (US); Abderrhamane Ounadjela, Paris (FR); Richard D. Joyce, Epping, NH (US); Jacques Jundt, Newton Highlands, MA (US); Douglas W. Grant, Austin, TX (US); Edward Harrigan, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 512 days.

(21) Appl. No.: 13/436,412

(22) Filed: Mar. 30, 2012

(65) Prior Publication Data

US 2013/0255367 A1 Oct. 3, 2013

(51) Int. Cl.
*E21B 49/08* (2006.01)

(52) U.S. Cl.
CPC ..... *E21B 49/082* (2013.01)

(58) Field of Classification Search
CPC ..... E21B 49/082; E21B 49/10
USPC ..... 73/152.25, 152.26
See application file for complete search history.

(56) References Cited

U.S. PATENT DOCUMENTS 3,864,970 A 2/1975 Bell
4,676,096 A * 6/1987 Bardsley et al. ..... 73/152.26
4,951,749 A * 8/1990 Carroll ..... 166/264
5,233,866 A * 8/1993 Desbrandes ..... 73/152.05
5,644,076 A 7/1997 Proett et al.
6,923,052 B2 * 8/2005 Krueger et al. ..... 73/152.22
7,152,466 B2 12/2006 Ramakrishnan et al.
7,178,392 B2 * 2/2007 Dhruva et al. ..... 73/152.51
8,757,986 B2 * 6/2014 Villareal et al. ..... 417/53
2004/0099443 A1 5/2004 Meister et al.
2004/0160858 A1 8/2004 Ciglence et al.
2005/0039527 A1 * 2/2005 Dhruva et al. ..... 73/152.27
2006/0016594 A1 * 1/2006 Krueger et al. ..... 166/250.07
2006/0243047 A1 * 11/2006 Terabayashi et al. ..... 73/152.55
2008/0245569 A1 * 10/2008 Nold et al. ..... 175/24
2008/0314137 A1 * 12/2008 Proett et al. ..... 73/152.22
2010/0264915 A1 10/2010 Saldungaray et al.

OTHER PUBLICATIONS

Bassevilee, et al., "Detection of Abrupt Changes: Theory and Application", 2.1.3 Finite Moving Average Control Charts, p. 33.
Basseville, et al., "Detection of Abrupt Changes: Theory and Application", 2.1.3 Finite Moving Average Control Charts, p. 33.
(Continued)

*Primary Examiner* — John Fitzgerald
(74) *Attorney, Agent, or Firm* — Daniel S. Matthews

(57) ABSTRACT

An apparatus, method and system are provided for characterizing fluid trapped in a subterranean formation using a downhole tool that includes an elongated body and a probe body. The probe body is moveable from and back into the elongated body. The probe body defines a flow line and supports a pressure sensor for measuring fluid pressure in the flow line, a piston and an electrical motor actuator that is adapted to move the piston in order to vary volume of the flow line. The integral electrical motor actuator, piston, pressure sensor and flow line of the probe body can provide for measurement of formation pressure and/or formation mobility.

30 Claims, 7 Drawing Sheets

(56) References Cited

OTHER PUBLICATIONS

Betancourt, et al., "Inducing Spherical Flow Conditions With Formation Testers", SPE 133523, SPE Annual Technical Conference and Exhibition, Sep. 19-22, 2010, 15 pages, Society of Petroleum Engineers.

Dussan, et al., "A Robust Method for Calculating Formation Mobility with a Formation Tester", SPE 143302, SPE Reservoir Evaluation and Engineering, Apr. 2011, pp. 239-247, Society of Petroleum Engineers.

* cited by examiner

APPARATUS, METHOD AND SYSTEM FOR MEASURING FORMATION PRESSURE AND MOBILITY

BACKGROUND

There are a variety of commercially available wireline formation testing tools used for determining the pressure and mobility of fluid trapped in a subterranean formation, which is typically referred to as a reservoir. A typical prior art wireline formation tester employs an elongated body adapted for downhole operation in a borehole that traverses a reservoir. A probe is deployable from the elongated body. The probe includes a deformable packer surrounding a flow line. The flow line extends into the elongated body. A pretest chamber is disposed within the elongated body in fluid communication with the flow line. A hydraulically-driven (or electrically-driven) piston moves within the pretest chamber. A pressure sensor measures fluid pressure of the flow line. Proper placement of the formation tester requires lowering the elongated body of the formation tester into the borehole and deploying the probe from the elongated body such that the probe interfaces to borehole wall.

Boreholes can be drilled with the borehole fluid pressure higher than the pressure of the formation fluids. This is called over-balanced drilling. Boreholes can also be drilled with the borehole pressure less than the pressure of the formation fluids. This is called under-balanced drilling.

In the case of the borehole drilled with over-balanced drilling, the borehole wall may be coated with mud cake that is formed from the circulation of drilling fluids through the borehole during drilling operations. The mud cake provides a seal (typically referred to as a mud cake seal) that isolates borehole drilling fluids from the reservoir fluids trapped in the formation adjacent the borehole in order to reduce the quantity of drilling fluid that flows from the borehole into the adjacent formation. Pressure and mobility of the reservoir fluids are measured with a procedure that includes a "drawdown" procedure followed by a "build-up" procedure. Before the "drawdown" procedure, the deformable packer is pushed against the mud cake and provides a seal between the packer and the mud cake, and the probe is pressed against the mud cake on the borehole wall. During the "drawdown" procedure, a small amount of formation fluid is extracted from the formation into the flow line of the probe. The purpose of the draw-down procedure is to establish fluid communication between the flow line and the formation fluid. Drawdown includes moving the piston in the pretest chamber to expand the volume of the flow line so that the pressure of the fluid in the flow line is reduced sufficiently below formation pressure causing the mud cake seal to break. The purposes of measuring the pressure of the fluid in the flowline during and after the drawdown are to verify good fluid communication between the flow line and the formation and to verify good fluid isolation between the flow line and the borehole fluid. During the "drawdown" procedure, the pretest piston is configured in a "retracted" position in the pretest chamber and the fluid in the flow line (including the pretest chamber) is at a pressure below the pressure of the reservoir fluid trapped in the formation adjacent the probe. The "build-up" procedure establishes pressure equilibrium between the fluid in the flow line and the reservoir fluid during a build-up time period. During the "build-up" procedure, the pretest piston remains stationary in the "retracted" position in the pretest chamber. Reservoir fluid flows from the formation into the flow line because the formation fluid pressure is higher than the fluid pressure in the flow line. Continued inflow allows the fluid pressure in the flow line to build up until equilibrium is established. When equilibrium is established, the fluid pressure in the flow line equals the formation fluid pressure (the fluid pressure of the reservoir fluids trapped in the formation adjacent the probe). The changing pressure in the flow line is monitored by the pressure sensor of the tool. Mobility of the formation can be calculated from the pressure of the flow line fluid during drawdown or during drawdown and build-up. Mobility is defined as the ratio of formation permeability (in unit Darcy) to formation viscosity (in Poise).

The pressure signal is needed during both drawdown and buildup in order to calculate mobility. In the case of the borehole drilled with under-balanced drilling, there is no mud cake seal and only mobility of the reservoir fluids is measured with a "drawdown" procedure and a "build-up" procedure. Before the "drawndown" procedure, the deformable packer is pushed against the borehole wall and provides a seal between the packer and the borehole wall, and the probe is pressed against the borehole wall. In the "drawn down" procedure, the pretest piston of the tool is configured in a "retracted" position in the pretest chamber and the fluid in the flow line (including the pretest chamber) is at a pressure below the pressure of the reservoir fluid trapped in the formation adjacent the probe. The "build-up" procedure allows for the reservoir fluid to flow into the flow line and establish pressure equilibrium between reservoir fluid and the fluid in the flow line during a build-up time period. During the "build-up" procedure, the pretest piston remains stationary in the "retracted" position in the pretest chamber. The changing pressure in the flow line is monitored by the pressure sensor of the tool. Mobility of the formation can be calculated using the drawdown pressure data or using the drawdown and the build-up pressure data measured by the tool. Mobility is defined as the ratio of formation permeability (in unit Darcy) to formation viscosity (in Poise).

SUMMARY

An apparatus, method and system are provided for making measurements of the pressure of fluid trapped in a subterranean formation using a downhole tool that includes an elongated body traversable within a borehole. A probe body is movable out of and back into the elongated body. The probe body defines an inflow aperture and a flow line whereby the inflow aperture is in fluid communication with the flow line. The probe body includes a pressure sensor for measuring fluid pressure in the flow line, a piston and an electrical motor actuator that moves the piston in order to vary volume of the flow line.

In one embodiment, the probe body includes a housing that is rigidly coupled to a barrel. The piston is movable within the barrel and the volume of the barrel vacated by movement of the piston is part of the flow line. The housing encloses and supports the electrical motor actuator. A shoe (or face plate) supports at least one sealing member that surrounds the barrel. The at least one sealing member is adapted to seal to the borehole wall during operation of the tool. A coupling between the shoe and the housing/barrel can be provided that allows for relative movement between the housing/barrel and the shoe. The coupling can include a spring element that provides a spring force that pushes the housing/barrel in a forward direction relative to the shoe. The spring force is used to maintain the barrel stationary in contact with the borehole wall while the shoe and sealing member move toward the borehole wall (for example, during compression of the at least one sealing member). The coupling can also include two separated hydraulic chambers to provide a force that pushes the housing to bend in a forward/backward direction relative to the shoe such as a hydraulic accumulator.

During operation, the motor housing and barrel of the probe body are moved to their most forward position relative to the shoe in order to ensure that the barrel is the first element to make contact with the borehole wall (possibly lined with mud cake). Next, the entire probe body is moved toward the borehole wall to compress the sealing member to ensure a seal between the sealing member and the borehole wall. After the probe barrel makes contact with the borehole wall, the barrel of the probe body is stationary against the borehole wall while the shoe and the at least one sealing member move toward the borehole wall; this minimizes the change in volume (compression) of the flow line.

The drawdown is accomplished with the electric motor actuator of the probe body. The electric motor actuator translates the piston into a retracted position in the probe barrel in order to expand the volume of the flow line. The electric motor actuator can be realized by an electrical motor that rotates a drive shaft as well as a harmonic drive that converts rotation of the drive shaft to reduced rotation of an output shaft. A rotating nut and helical rib or groove can be provided that converts rotation of the output shaft to translation of the piston. A thrust bearing can interface to the rotating nut.

After breaking the mud cake seal (if required), a build-up procedure allows for the reservoir fluid to flow into the flow line and establish pressure equilibrium between reservoir fluid and the fluid in the flow line during a build-up time period. During the build-up procedure, the piston remains stationary in a retracted position in the probe barrel. The changing pressure in the flow line is monitored by the pressure sensor of the tool during the build-up time period.

For boreholes drilled with over-balanced drilling methods, the flow line pressures measured by the integral pressure sensor of the probe body during the build-up procedure can be used to derive formation pressure as well as formation mobility. Formation mobility is defined as the ratio of formation permeability (in unit Darcy) to formation viscosity (in Poise).

For boreholes drilled with under-balanced drilling methods, the flow line pressures measured by the integral pressure sensor of the probe body during the build-up procedure can be used to derive formation mobility. Formation mobility is defined as the ratio of formation permeability (in unit Darcy) to formation viscosity (in Poise).

In one embodiment, two types of formation mobility can be determined from the measured build-up pressure data. One type is the formation mobility obtained using the amplitude of the pressure signal, usually referred to as drawdown mobility. This measurement has a very shallow depth of investigation; therefore, it characterizes only the formation in the immediate vicinity of the probe, i.e., it is an indicator of the mobility at the wellbore wall, where formation damage is likely to occur for boreholes drilled with over-balanced drilling methods. The uncertainty associated with this mobility measurement decreases when the drawdown is long enough to approximate steady state flow. The second type of formation mobility is determined by analyzing the pressure transient signal during the late stage of buildup, during the so-called spherical flow period, hence it is referred to as the spherical mobility. This method has the advantage of characterizing properties deeper in the formation.

DETAILED DESCRIPTION

Figure 1:
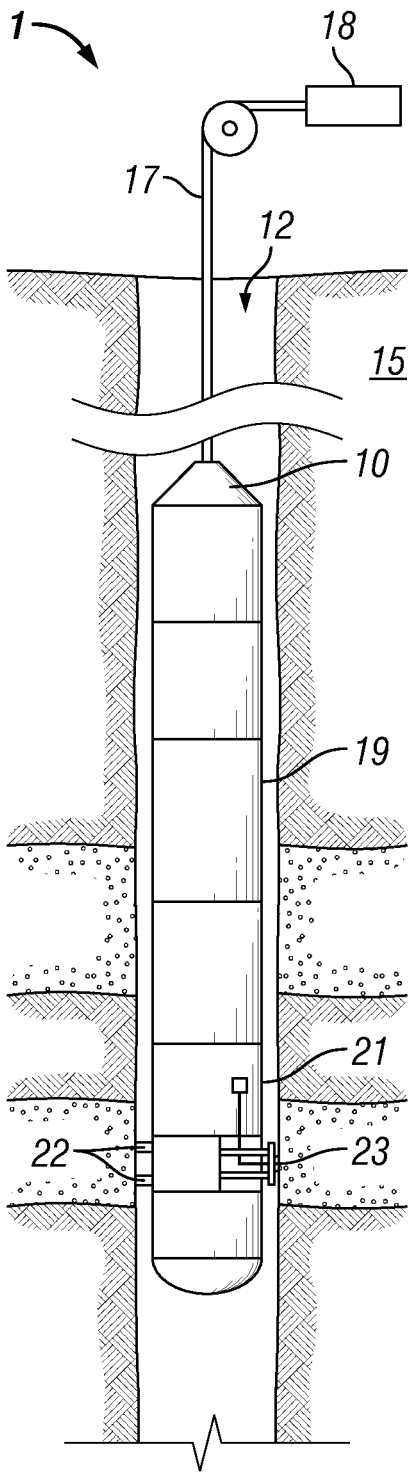
FIG. 1 is a schematic illustration of a hydrocarbon-bearing reservoir analysis system.

In the following discussion and in the claims, the terms "including" and "comprising" are used in an open-ended fashion, and thus should be interpreted to mean "including, but not limited to . . . . " Also, the terms "couple," "couples," and "coupled" used to describe any mechanical or electrical connections are each intended to mean and refer to either an indirect or a direct mechanical or electrical connection. Thus, for example, if a first device "couples" or is "coupled" to a second device, that interconnection may be through an electrical conductor directly interconnecting the two devices, or through an indirect electrical connection via other devices, conductors and connections. Further, reference to "up" or "down" are made for purposes of ease of description with "up" meaning towards the surface of the borehole and "down" meaning towards the bottom or distal end of the borehole. Moreover, reference to "forward" or "distal" movement of the probe (or parts thereof) means toward the borehole wall, and reference to "rearward" or "proximal" or "retracting" or "retraction" movement of the probe (or parts thereof) mean away from the borehole wall. In addition, in the discussion and claims that follow, it may be sometimes stated that certain components or elements are in fluid communication. By this it is meant that the components are constructed and interrelated such that a fluid could be communicated between them, as via a passageway, tube or conduit.

In the drawings and description that follows, like parts are marked throughout the specification and drawings with the same reference numerals, respectively. The drawing figures are not necessarily to scale. Certain features may be shown exaggerated in scale or in somewhat schematic form and some details of conventional elements may not be shown in the interest of clarity and conciseness. Specific embodiments are described in detail and are shown in the drawings, with the understanding that the present disclosure is not intended to limit the claims to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

FIG. 1 illustrates a hydrocarbon-bearing reservoir analysis system 1. A borehole 12 is drilled such that it traverses a subterranean hydrocarbon-bearing reservoir 15. The system 1 includes a formation tester 10 suspended in the borehole 12 from the lower end of a typical multiconductor cable 17 that is spooled in a usual fashion on a suitable winch on the formation surface. The cable 17 is electrically coupled to an electrical control system 18 on the formation surface. The formation tester 10 includes an elongated body 19 that is sized and shaped to traverse through the borehole 12 to multiple locations within the borehole during analysis of the reservoir. A portion 21 of the elongated body 19 carries a tool anchoring arrangement 22 and a probe 23 which are respectively arranged on opposite sides of the body 19. With the tool body 19 positioned in a desired location along the borehole 12, the tool anchoring arrangement 22 and the probe 23 are deployed from the tool body 19 (i.e., are moved radially outward toward the wall of the borehole) such that both the tool anchoring arrangement 22 and the probe 23 are in physical contact with the borehole wall and exert opposed forces that hold the tool body 19 stationary at the desired location in the borehole 12. In one embodiment, the tool anchoring arrangement 22 is realized by hydraulic anchoring pistons that are deployed from the tool body 19 for physical contact with the borehole wall. Alternatively, electro-mechanical actuators, pneumatic actuators or other suitable actuators can be used. Moreover, the probe 23 can employ hydraulic arms that deploy the probe 23 from tool body 19 for physical contact with the borehole wall (and for retracting the probe 23 back into the tool body 19). Alternatively, electro-mechanical actuators, pneumatic actuators or other suitable actuators can be used to deploy the probe 23 from tool body 19 for physical contact with the borehole wall (and for retracting the probe 23 back into the tool body 19).

Figure 2:
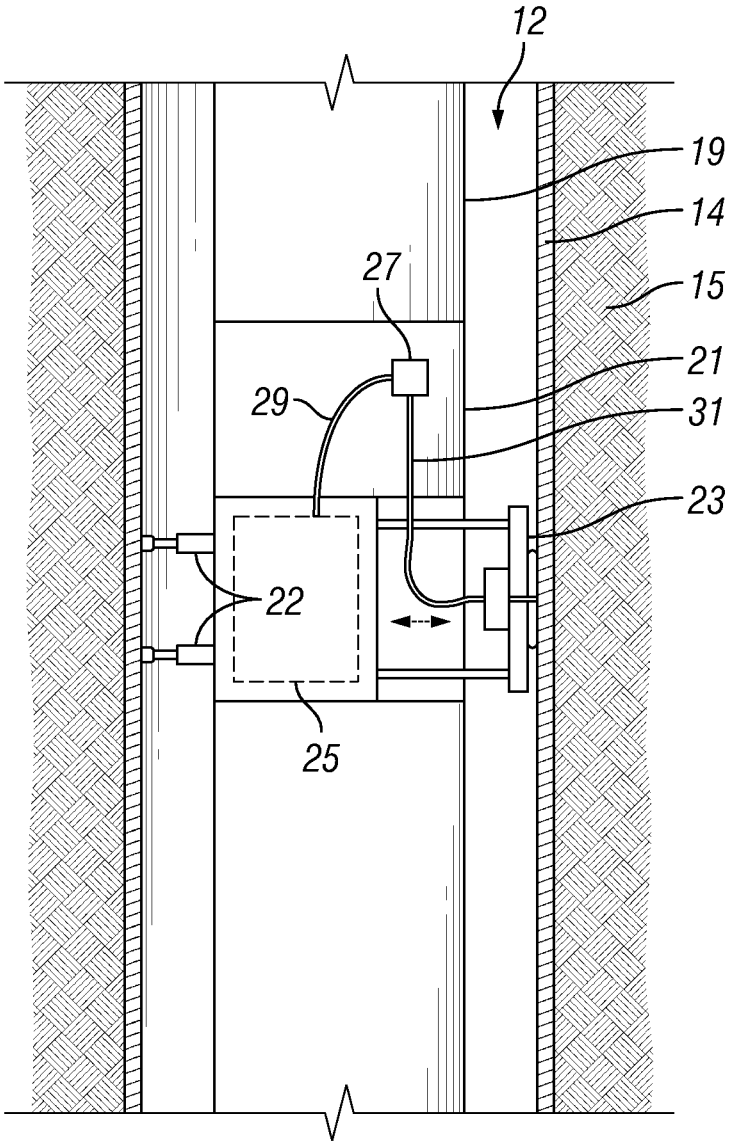
FIG. 2 is a schematic illustration of an embodiment of a formation fluid measurement tool, which is part of the reservoir analysis system of FIG. 1

FIG. 2 shows both the tool anchoring arrangement 22 and the probe 23 deployed from the tool body 19 and in physical contact with the borehole wall 14. The borehole wall can be coated with mud cake that is formed by the circulation of drilling fluids through the borehole during drilling operations. The mud cake provides a seal (referred to herein as a mud cake seal) that isolates the drilling fluids from the formation fluids adjacent the borehole in order to reduce the quantity of drilling fluid that flows from the borehole 12 into the adjacent formation. A probe driver 25 (such as electrically-controlled hydraulic pumps and valves or an entirely electric actuator) effectuates the movement of the tool anchoring arrangement 22 and the probe 23 for deployment from the tool body 19 and retraction back into the tool body 19. Control electronics 27 supply electrical signals to the probe driver 25 via multi-conductor cable 29 in order to control the movement of the tool anchoring arrangement 22 and the probe 23 relative to the tool body 19. The probe 23 includes a pressure sensor as well as an electrical motor actuator as described below. The pressure sensor of the probe 23 outputs electrical signals that carry the fluid pressure measured by the pressure sensor. These electrical signals are communicated from the pressure sensor of the probe 23 to the control electronics 27 of the tool body 19 via a flexible multi-conductor cable 31 for processing as described herein. The electrical motor actuator of the probe 23 moves a piston in order to vary volume of the flow line in response to the electrical signals supplied thereto. The electrical signals that control the electrical motor actuator of the probe 23 are generated by the control electronics 27 of the tool body 19 and supplied to the electrical motor actuator of the probe 23 via the flexible multi-conductor cable 31. The control electronics 27 can communicate with the surface-located electrical control system 18 via data telemetry in order to carry out the formation pressure and mobility measurements as described herein and store such measurement data (or communicate such data to a remote site) as appropriate.

Figure 3:
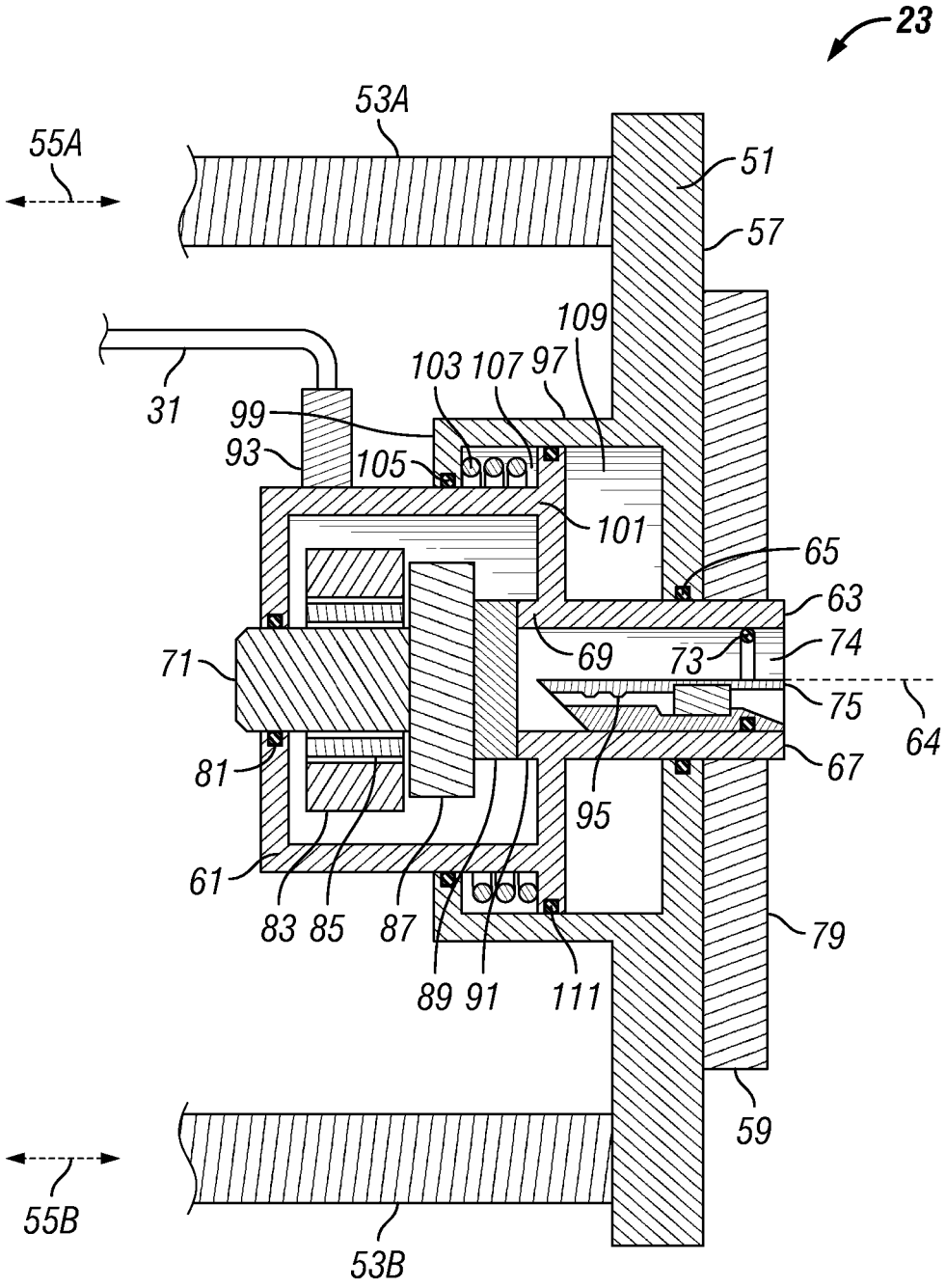
FIG. 3 is a schematic illustration showing details of the formation fluid measurement tool of FIG. 2.

FIG. 3 shows details of an embodiment of the probe 23, which includes a shoe 51 which is rigidly coupled to a pair of extendable arms 53A, 53B that are actuated by the probe driver 25 (FIG. 2) to move radially with respect to the tool body 19 in the directions of arrows 55A and 55B. The shoe 51 has a surface or other structure 57 that faces the borehole wall (mud cake 14 in FIG. 2). The surface or other structure 57 supports one or more sealing members (one shown as 59). The one or more sealing members 59 can be coupled to the shoe 51 via mechanical fasteners, adhesive, and/or other means. For example, the one or more sealing members 59 may be molded (e.g., via injection molding) to apertures or other structures of the shoe 51.

The shoe 51 provides structure and/or support to the one or more sealing members 59. As such, the shoe 51 may be formed of and/or include a metal, such as steel, and/or any other rigid materials. Alternatively, the shoe 51 may be formed of and/or include a less rigid material and/or a non-rigid material, such as a compliant and/or bendable material. The one or more sealing members 59 are preferably formed of and/or include an elastomeric material or a combination of elastomeric material and metal reinforcements. The one or more sealing members 59 are generally deformable to provide a proper seal to the borehole wall (the mud cake 14 of FIG. 2). The one or more sealing members 59 can be inflatable to allow for expansion and contraction of the one or more sealing members 59 as controlled by the supply of working fluid to the one or more sealing members 59.

The shoe 51 is mechanically coupled to an electrically-motorized piston pump assembly supported and enclosed by a housing 61. An elongate barrel 63 is rigidly mounted to (or integrally formed with) the housing 61 and extends toward the borehole wall (the mud cake 14 of FIG. 2) with a central axis 64 as shown. The shoe 51 and the sealing member 59 include a central opening (aligned with the central axis 64) that receives the barrel 63. The opening of the shoe 51 includes a seal 65 that interfaces to the exterior surface of the barrel 63 and blocks fluid flow in the space between the opening and the exterior surface of the barrel 63. The seal 65 can be adapted to accommodate movement of the barrel 63 relative to the shoe 51. The seal 65 can be formed from an elastomeric material, such as polyether ether ketone (PEEK). The barrel 63 has an open front end 67 that faces the borehole wall (the mud cake 14 of FIG. 2) and an open rear end 69 that leads into the interior space of the housing 61. A piston 71 is disposed inside the barrel 63 and slides (translates) along the central axis 64. The cross-sectional shape of the exterior surface of the piston 71 corresponds to the cross-sectional shape of the interior wall of the barrel 63 such that the interior wall of the barrel 63 guides the sliding motion of the piston 71 inside the barrel 63. These cross-sectional shapes may be square or otherwise rectangular in nature, oval in nature or possibly some other shape. The piston 71 is mechanically prevented from rotating inside the barrel 63. Alternatively, these cross-sectional shapes can be circular in nature or some other arbitrary shape. The piston 71 includes a sealing element 73 that rests in a groove in the exterior surface of the piston 71 and blocks fluid flow in the space between the piston 71 and the barrel 63. The piston 71 can extend rearward through an opening in the end wall of the housing 61 as shown. In this case, the opening in the end wall of the housing 61 can include a seal 81 that interfaces to the exterior surface of the piston 71 and blocks fluid flow in the space between the opening and the exterior surface of the piston 71. The seal 81 can be adapted to accommodate movement of the piston 71 relative to the housing 61. The seal 81 can be realized from an elastomeric material, such as nitrile rubber, carboxylated nitrile, ethylene acrylate, ethylene propylene rubber, butyle rubber, chloroprene rubber, etc.

As shown in the cut-out portion of the piston 71 in FIG. 3, the distal end of the piston 71 facing the borehole wall (the mud cake 14 of FIG. 2) includes an aperture 75 that extends into the interior of the piston 71. In this manner, the extended aperture 75 is defined by an interior bore of the piston 71. A pressure sensor 79 is mounted in the piston 71 with access to the extended aperture 75. During operation, the piston 71 can be configured such that the distal face of the piston 71 is positioned substantially flush with the distal end 67 of the barrel 63 as shown in FIG. 3. From this initial position, the piston 71 slides rearwardly away from the borehole wall. The interior space of the barrel 63 that is vacated by the retraction of the piston 71 together with the volume of the extended aperture 75 and any dead volume of the pressure sensor 79 collectively define a low volume flow line for receiving formation fluid extracted from the formation in front of the vacated volume of the probe barrel 63 as described herein. The flow line can have a volume less than 1 $cm^3$. The pressure sensor 79 is used to measure pressure of the formation fluid in the flow line and derive a measure of formation pressure and/or other related parameters such as formation mobility as described herein. A check valve may be included in the flow line to ensure that the flow line pressure does not exceed that of the borehole in the event that the entrapped fluid is compressed after an isolating seal is established when the probe 23 is set against the borehole wall (block 405 of FIG. 4).

The housing 61 encloses and supports an electrical motor actuator that drives the sliding motion of the piston 71. In one embodiment, the electrical motor actuator can include an electrical motor (for example, a brushless motor including a stator 83 and a rotor 85 as shown) that rotates a drive shaft (not shown), a harmonic drive 87 that converts rotation of the drive shaft to reduced rotation of an output shaft (not shown), and a transmission that converts rotation of the output shaft to sliding motion (i.e., translation) of the piston 71 inside the barrel 63. The rotational axes of the rotor/drive shaft of the motor and the output shaft of the harmonic drive are in line with the translation axis of the piston 71. The harmonic drive 87 can provide a large reduction ratio for the rotation of the rotor/drive shaft relative to the output shaft (such as a ratio of 1 rotation of the output shaft for 80 rotations of the rotor/drive shaft). A reduction in rotation rate can provide a proportionate increase of the torque transmitted the transmission, allowing the application of large forces to the piston 71. The transmission can be realized by a helical rib or groove that is integrally formed (or mounted to) the piston 71 and that interfaces to a complementary helical groove or rib of a rotating nut 89 that is driven by the output shaft of the harmonic drive 87. A thrust bearing 91 can provide an interface between the rotating nut 89 and the rear end of the barrel 63. The thrust bearing 91 may allow the nut 89 to rotate with minimal friction while transmitting the load of the piston to the rear end of the barrel 63. Alternatively, the electrical motor actuator can be realized by a linear motor (such as a stepper motor) or another type of electrically-driven motor actuator, such as a piezo-electric actuator (e.g., a PZT inchworm actuator) or a magnetostrictive actuator (such a Terfenol D crystal) driven by time-varying electromagnetic fields.

The electrical motor actuator housed within the housing 61 is controlled by control electronics 27 integral to the tool body 19. The electrical signals that control the electrical motor actuator are generated by the control electronics 27 and supplied to the electrical motor actuator via the flexible multi-conductor cable 31 and feed-through connector 93. The pressure sensor 79 of the probe 23 outputs electrical signals that carry the fluid pressure measured by the pressure sensor 79. These electrical signals are communicated from the pressure sensor 79 to the control electronics 27 of the tool body 19 via wiring 95 that extends rearward within the internal body of the piston 71 and exits from the rear-portion of the piston (not shown) and extends to the feed-through connector 93. The connector 93 provides for connection to the multi-conductor cable 31, which is coupled to the control electronics 27.

In one embodiment, the probe 23 employs a coupling between the shoe 51 and the housing 61 and barrel 63 that allows for movement of the housing 61 and barrel 63 relative to the shoe 51. Such coupling may guide the movement of the housing 61 and the barrel 63 relative to the shoe 51 such that it is aligned to the translation axis of the piston 71 (i.e., the central axis 64 of the barrel 63). An example of such a coupling is shown in FIG. 3 where the shoe 51 includes a flange 97 that extends rearward away from the front surface 57 with an end wall 99 that terminates adjacent the housing 61. The housing 61 has a shoulder portion 101 that extends parallel to the end wall 99 in a location offset distally from the end wall 99 (i.e., closer to the front surface 57 of the shoe 51). The shoulder portion 101 includes seal 111 and terminates adjacent the interior surface of the flange 97. The flange 97 and end wall 99 of the shoe 51 cooperate with the shoulder portion 101 of the housing 61 to guide the movement of the housing 61 relative to the shoe 51 such that it is aligned to the translation axis of the piston 71 (i.e., the central axis 64 of the barrel 63). A spring element 103 can be captured in the space between the end wall 99 and the shoulder portion 101 to provide a spring bias that pushes the housing 61 in a forward direction relative to the shoe 51. The spring force is used to maintain the barrel 63 stationary in contact with the borehole wall while the shoe 51 and the sealing member(s) 59 move toward the borehole wall (for example, during compression of the at least one sealing member 59). A seal 105 provides an interface between the end wall 99 and the exterior surface of the housing 61 and blocks fluid flow in the space between the end wall 99 and the housing 61. The seal 111 provides an interface between end wall 99 and the shoulder 101 of the housing 61 that accommodates movement of the housing 61 relative to the shoe 51, and blocks fluid flow between chambers 107 and 109. The seals 105, 111 can be formed from an elastomeric material, such as polyether ether ketone (PEEK). The shoe/housing coupling can utilize two separate hydraulic lines connected to chambers 107 and 109, which are both filled with hydraulic fluid. The chambers 107 and 109 are fluidly isolated from one another by seal 111 where the housing 61 interfaces to the flange 97 of the shoe. The pressures in the hydraulic lines are controlled to regulate the differential pressure in the two chambers 107/109 in order to control movement of the housing 61 relative to the shoe 51. This arrangement can possibly allow the barrel 63 to apply a large force to the borehole wall during operation. A pressure sensor and solenoid valve can be integrated into the probe 23 to measure and control the pressures in chambers 107 and 109 for precise control of the force exerted by the barrel 63 onto the borehole wall during operation.

In an alternate embodiment, the electrically-driven motor actuator that drives the piston 71 can include a one-way ratchet mechanism for limiting sliding movement (i.e., translation) of the piston 71 in the barrel 63 in the radial direction away from the borehole wall (the mud cake 14 of FIG. 2). In this manner, the one-way ratchet mechanism may prevent sliding movement (i.e., translation) of the piston 71 in the barrel 63 in the opposed radial direction toward the borehole wall. The one-way ratchet mechanism can selectively control the movement of the piston 71, and thus be disengaged to allow for sliding movement (i.e., translation) of the piston 71 in the barrel 63 in the radial direction toward the borehole wall for other operations (e.g., in order to prepare the probe 23 for a subsequent formation pressure measurement).

In yet another alternative embodiment, the electrically-driven motor actuator that drives the piston 71 can include an electrical motor (e.g., brushless stator and rotor) that rotates a drive shaft oriented in a direction perpendicular to the translation axis of the piston 71, and a miter gear for converting rotation of the drive shaft to rotation of an output shaft aligned with the translation axis of the piston 71. A transmission (e.g., a rotating nut that interfaces to a helical rib or groove in rear portion of the piston 71) converts rotation of the output shaft of the miter gear to sliding motion (i.e., translation) of the piston 71 inside the barrel 63. The miter gear and/or the transmission can provide for reduction that increases the forces that are applied to the piston 71.

Figure 4:
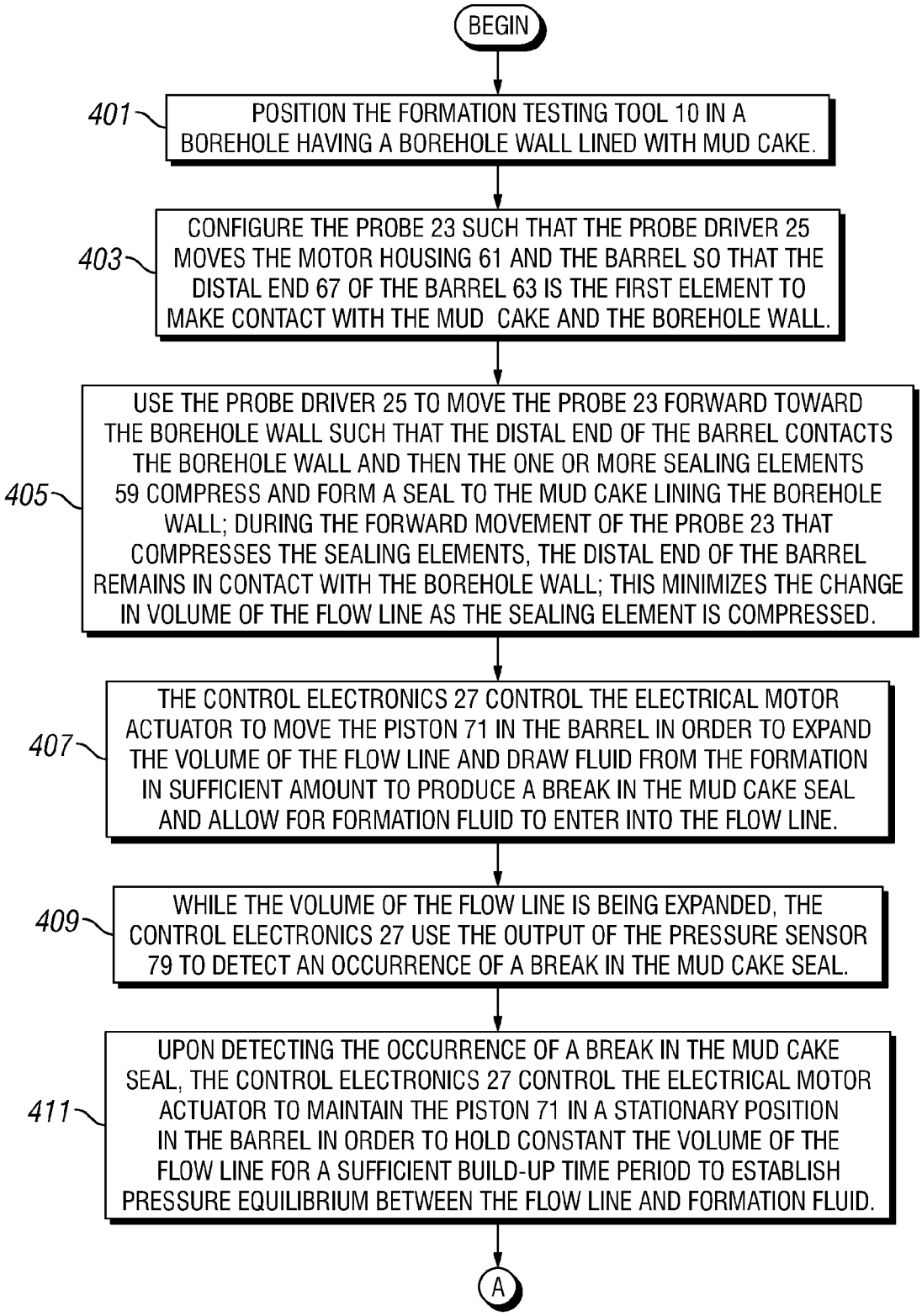
FIGS. 4 and 5, collectively, are a flowchart of an embodiment of a method which employs the formation fluid measurement tool of FIGS. 2 and 3 to make a measurement of formation pressure.
Figure 5:
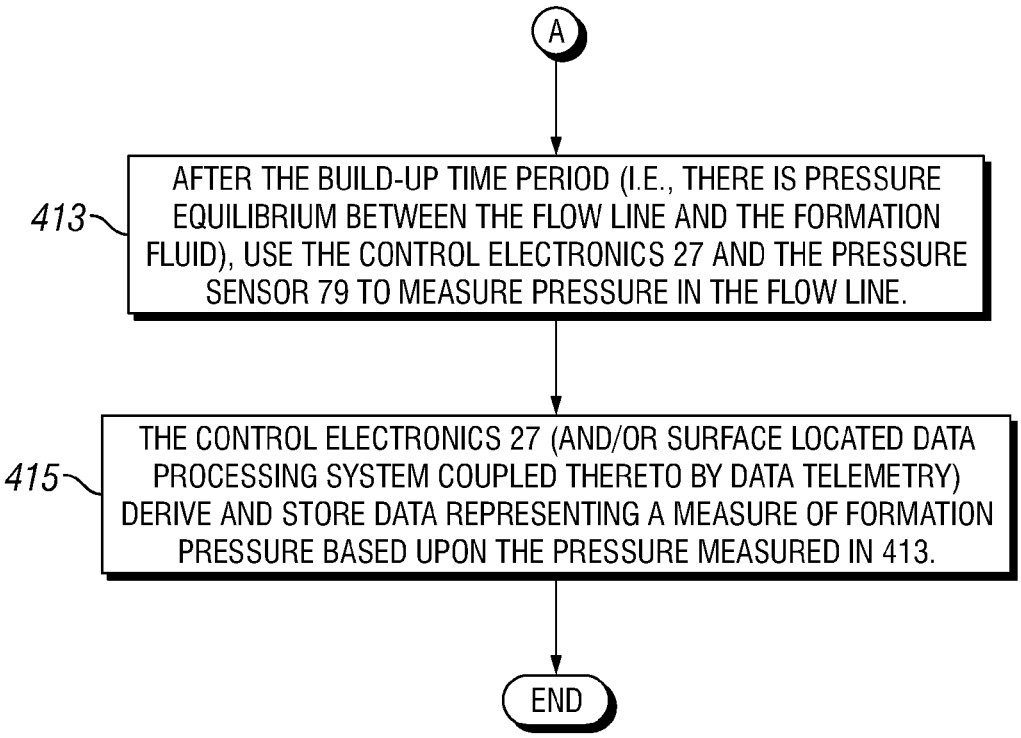

An embodiment of a method for determining formation fluid pressure utilizing the formation tester tool 10 as described herein is illustrated in the flow chart of FIGS. 4 and 5. The method begins in block 401 wherein the formation testing tool 10 is positioned in a borehole drilled from an over-balanced drilling method. Thus, the borehole wall can be lined with mud cake (FIG. 2).

In block 403, the probe 23 is configured such that the drive 25 is used to deploy the motor housing 61 and barrel 63 to their most forward position relative to the shoe 51 in order to ensure that the distal end 67 of the barrel 63 is the first element to make contact with the borehole wall. In this configuration, the barrel opening 75 is positioned beyond the sealing member(s) 59 as shown in FIG. 3.

In block 405, the probe drive 25 is used to move the entire probe 23 forward toward the borehole wall such that the distal end 67 of the barrel 63 is positioned against the borehole wall. Such forward movement continues such that the sealing element(s) 59 compresses and forms a seal to the borehole wall. This seal isolates the flow line of the probe 23 from the fluid in the borehole.

In block 407, the control electronics 27 are used control the electrical motor actuator to move the piston 71 in the barrel 63 in order to expand the volume of the flow line. Such volume expansion is sufficient to produce a break in the mud cake seal and allow for formation fluid to enter into the flow line. In one embodiment, the volume of the flow line is expanded at a controlled predetermined constant rate by retracting the piston 71 in the probe barrel 63 at a constant velocity. Alternatively, a control algorithm may be used to control retraction of the piston 71 in the probe barrel 63 based on the first time-derivative of tool pressure.

In block 409, while the volume of the flow line is being expanded, the control electronics 27 are used to monitor the output of the pressure sensor 79 to detect an occurrence of a break in the mud cake seal.

Figure 6:
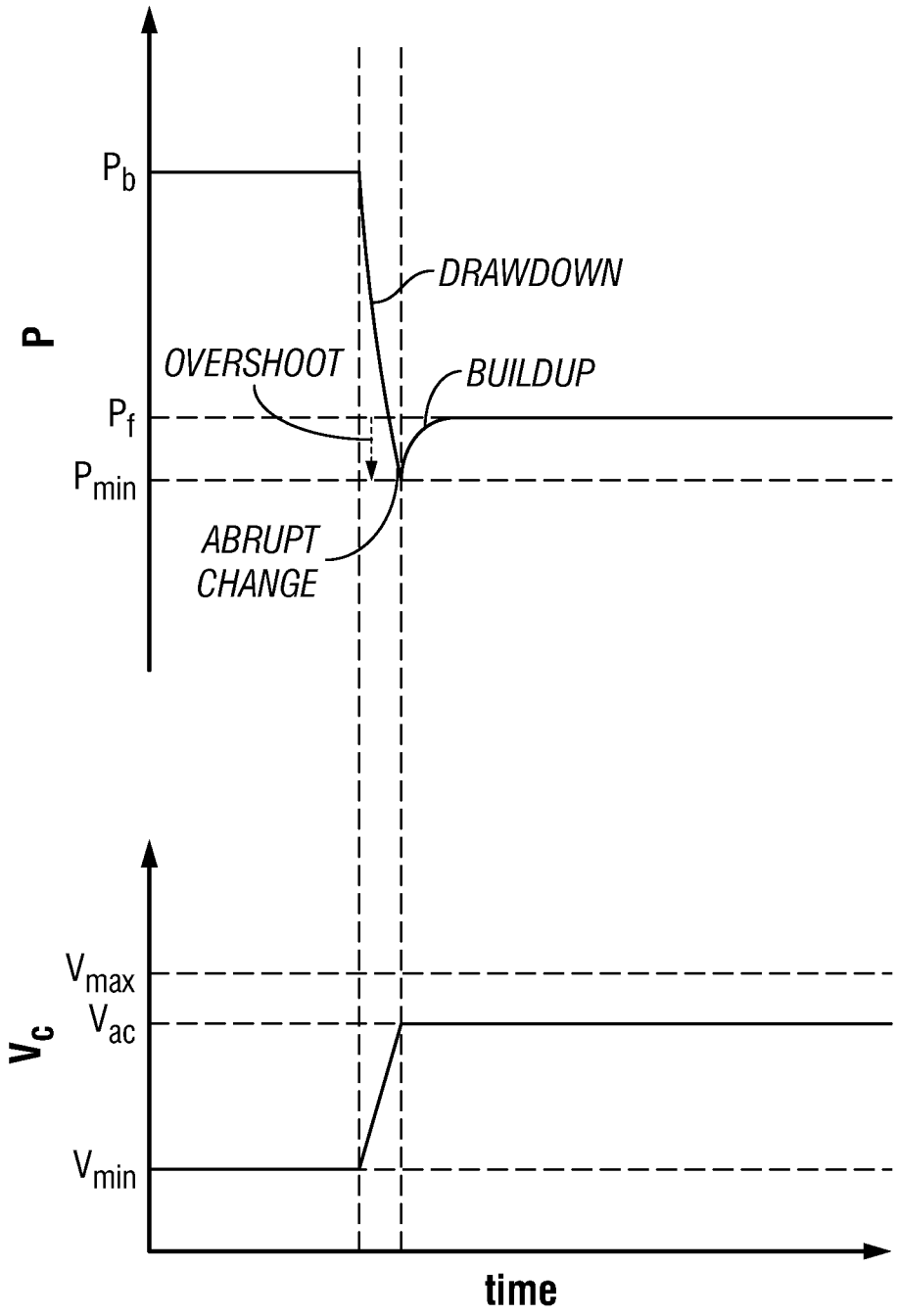
FIG. 6 is a graph illustrating the rate of change of flow line volume as related to flow line pressure in one embodiment of the method of FIGS. 4 and 5.

In one embodiment, the occurrence of a break in the mud cake seal can be identified by detecting an abrupt change in flow line pressure P output by the pressure sensor 79. With reference to FIG. 6, as the flow line volume $V_c$ expands during drawdown, the decrease in the flow line pressure P occurs smoothly until the mud cake begins to detach from the borehole wall. When this happens, hydraulic communication has been established with the reservoir. This event is marked by an abrupt change in the character of the flow line pressure P output by the pressure sensor 79. The drawdown process can be terminated upon identifying an abrupt change in P. The abrupt change in P may be detected by any one of a number of known mathematical methods of detecting an abrupt change, such as monitoring the change in P over time or monitoring the value of one its first or second time derivatives using a finite moving average (FMA) algorithm. This algorithm is discussed in "Detection of Abrupt Changes Theory and Application," Michele Bassevilee and Igor Nikiforov, a book, available from P T R Prentice Hall, Englewood Cliffs, N.J. 07631. The FMA algorithm is discussed under 2.1.3 "Finite Moving Average Control Charts" on page 38.

Figure 7:
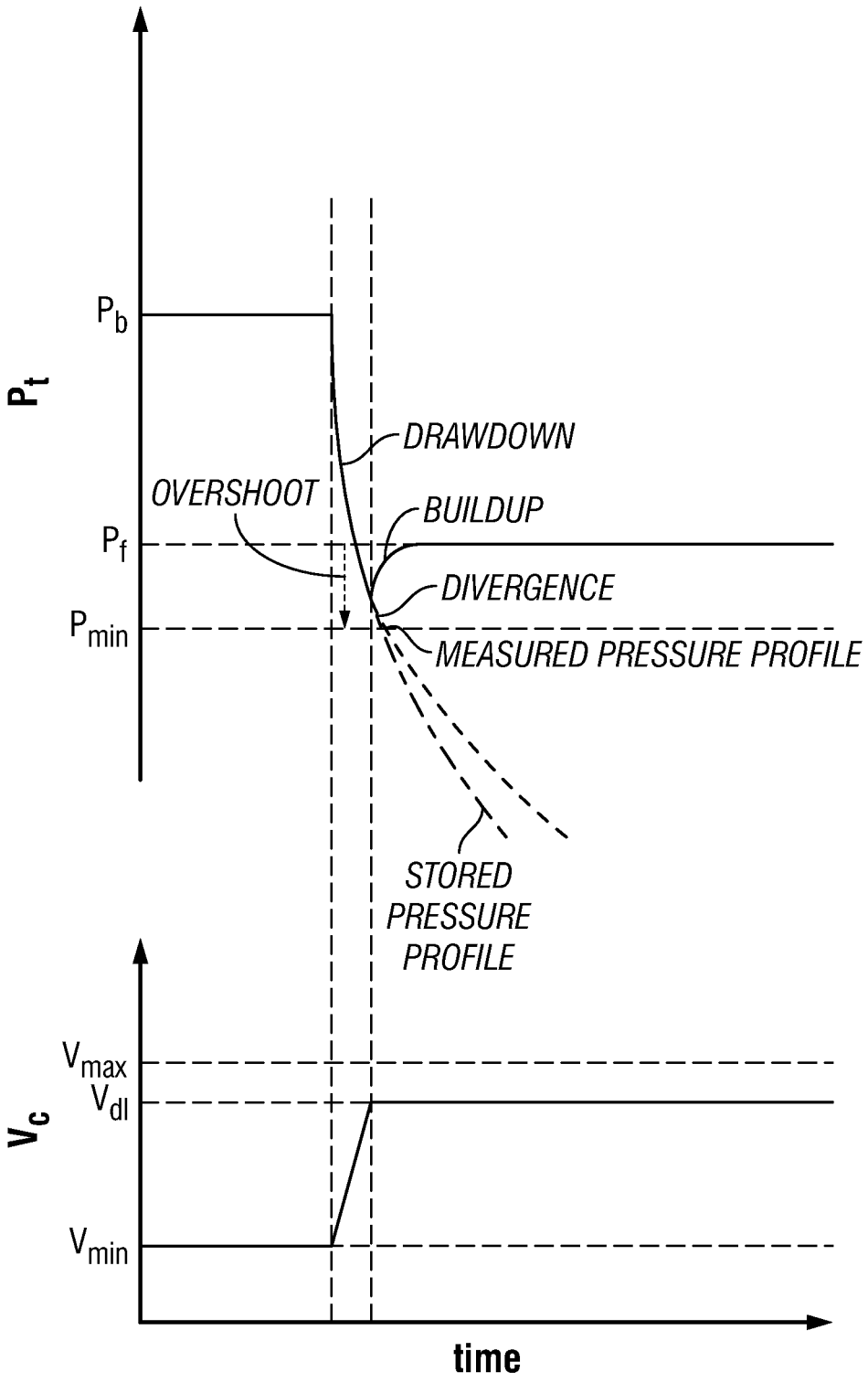
FIG. 7 is a graph illustrating the rate of change of flow line volume as related to flow line pressure in another embodiment of the method of FIGS. 4 and 5.

In another embodiment, the occurrence of a break in the mud cake seal can be identified by detecting a divergence in the flow line pressure P output by the pressure sensor 79 as compared to a reference tool pressure profile. With reference to FIG. 7, the flow line pressure P output by the pressure sensor 79 is compared to a reference tool pressure profile during drawdown. The drawdown process can be terminated upon detecting divergence between the measured pressure and the model.

In block 411, upon detecting the occurrence of a break in the mud cake seal, the control electronics 27 controls the electrical motor actuator of the probe 23 to maintain the piston 71 in a stationary position in the barrel 63 in order to hold constant the volume of the flow line for a sufficient build-up time period to establish pressure equilibrium between the flow line and the formation fluid.

In block 413, after a build-up time period (i.e., when there is pressure equilibrium between the flow line and the formation fluid), the control electronics 27 and the pressure sensor 79 are used to measure pressure in the flow line.

In block 415, the control electronics 27 (and/or surface located data processing system coupled thereto by data telemetry) are used to derive and store data representing a measure of formation pressure based upon the pressure measured in 413.

The operations of blocks 403-415 can be repeated for multiple formation pressure measurements at a given location in the borehole. Clean up operations (such as sonic washing) can be performed between such pressure measurements. Similarly, the operations of blocks 401-415 can be repeated for multiple formation pressure measurements at different locations in the borehole. Clean up operations (such as sonic washing) can be performed between such pressure measurements.

For boreholes drilled with over-balanced drilling methods, the flow line pressures measured by the integral pressure sensor of the probe body during the build-up procedure can be used to derive formation pressure as well as formation mobility. Formation mobility is defined as the ratio of formation permeability (in unit Darcy) to formation viscosity (in Poise).

Operations similar to blocks 403-415 can be used to measure pressure within a borehole drilled with under-balanced drilling methods. In this case, the flow line pressures measured by the integral pressure sensor of the probe body during the build-up procedure can be used to derive formation mobility. Formation mobility is defined as the ratio of formation permeability (in unit Darcy) to formation viscosity (in Poise).

In one embodiment, two types of formation mobility can be determined from the measured build-up pressure data. One type is the formation mobility obtained using the amplitude of the pressure signal, usually referred to as drawdown mobility. This measurement has a very shallow depth of investigation; therefore, it characterizes only the formation in the immediate vicinity of the probe, i.e., it is an indicator of the mobility at the wellbore wall, where formation damage is likely to occur for boreholes drilled with over-balanced drilling methods. The uncertainty associated with this mobility measurement decreases when the drawdown is long enough to approximate steady state flow. Another method for determining drawdown mobility is presented in E. B. Dussan V. in "A Robust Method for Calculating Formation Mobility with a Formation Tester" SPE Reservoir Evaluation and Engineering April 2011, which is incorporated by reference herein. An additional type of formation mobility is determined by analyzing the pressure transient signal during the late stage of buildup, during the so-called spherical flow period, hence it is referred to as the spherical mobility. This method has the advantage of characterizing properties deeper in the formation. Details of such measurements are described by S. Betancourt, E. B. Dussan V., and L. Lake in "Inducing Spherical Flow Conditions With Formation Testers," SPE Annual Technical Conference and Exhibition, September, 2010, which is incorporated by reference herein.

The downhole tools and methods as described herein can be integrated into wireline tools (FIG. 1) as well as any of a number of different types of tools including measurement-while-drilling ("MWD") tools, logging-while-drilling ("LWD") tools, etc. The designation "MWD" or "LWD" are used to mean all generic measurement while drilling or logging while drilling apparatus and systems. The downhole tools and methods as described herein can be used for measuring the pressure of hydrocarbon-bearing fluid (such as petroleum oil and/or natural gas) trapped in a subterranean formation as well as other fluids (such as carbon dioxide in carbon sequestration applications) trapped in a subterranean formation.

There have been described and illustrated herein several embodiments of an apparatus, method and system for making measurement of pressure and mobility of fluid entrapped in a subterranean formation. While particular embodiments have been described, it is not intended that the claims be limited thereto, as it is intended that the claims be as broad in scope as the art will allow and that the specification be read likewise. It will therefore be appreciated by those skilled in the art that yet other modifications could be made to the provided embodiments without deviating from their spirit and scope as claimed.

What is claimed is:

1. A tool for characterizing an earth formation surrounding a borehole having a borehole wall, the tool comprising:
- an elongated body adapted for downhole operation in the borehole; and
- a probe body, moveable out of and back into the elongated body, the probe body defining a flow line and including
  - at least one sealing member configured to seal the borehole wall during operation of the tool,
  - a shoe that supports the at least one sealing member,
  - a barrel configured to contact the borehole wall to position a distal end of the fluid line at the borehole wall,
  - a pressure sensor for measuring fluid pressure in said flow line,
  - a piston, and
  - an electrical motor actuator that is adapted to move said piston in order to vary volume of said flow line,
- wherein the barrel is moveable relative to the shoe such that the barrel is configured to maintain contact with the borehole wall while the shoe and the at least one sealing member are moved toward the borehole wall.

2. A tool according to claim 1, wherein:
- said at least one sealing member and said barrel have a first configuration wherein a distal portion of said barrel extends away from said elongated body beyond said at least one sealing member.

3. A tool according to claim 1, further comprising:
- actuation means, mechanically coupled to said shoe, for extending said probe body from said elongated body and retracting said probe body back into said elongated body.

4. A tool according to claim 1, further comprising:
- control electronics integral to said elongated body; and
- electrical conductors, coupled between said control electronics and said electrical motor actuator, for communicating electrical signals between said control electronics and said electrical motor actuator in order to control said electrical motor actuator.

5. A tool according to claim 1, wherein:
- said electrical motor actuator comprises an electrical motor selected from the group including a brushless motor and a linear motor.

6. A tool according to claim 1, wherein:
- said electrical motor actuator further comprises a one-way ratchet mechanism for limiting translation of the piston in one direction toward said elongated body.

7. A tool according to claim 1, wherein:
- said electrical motor actuator comprises an electrical motor that rotates a drive shaft oriented in a direction perpendicular to the translation axis of said piston, and a miter gear for converting rotation of said drive shaft to rotation of a shaft aligned with the translation axis of said piston.

8. A tool according to claim 1, wherein:
- said piston has an aperture extending into an interior bore, wherein said interior bore is part of said flow line.

9. A tool according to claim 1, wherein the flow line has a volume less than 1 $cm^3$.

10. A tool according to claim 1, wherein:
- said electrical motor actuator comprises an electrical motor that rotates a drive shaft as well as a harmonic drive that converts rotation of said drive shaft to reduced rotation of an output shaft.

11. A tool according to claim 10, wherein:
- said electrical motor actuator further comprises a rotating nut that converts rotation of said output shaft to translation of said piston in order to vary volume of said flow line.

12. A tool according to claim 11, wherein:
- said electrical motor actuator further comprises a thrust bearing that interfaces to said rotating nut.

13. A tool according to claim 12, wherein:
- said pressure sensor is mounted to said piston with access to said interior bore of said piston.

14. A tool according to claim 1, wherein:
- said piston is movable within said barrel and volume of said barrel vacated by movement of said piston is part of said flow line.

15. A tool according to claim 14, wherein:
- said probe body further comprises a housing that is rigidly coupled to said barrel, wherein said housing encloses and supports said electrical motor actuator.

16. A tool according to claim 15, wherein:
- said shoe is mechanically coupled to said housing and said barrel.

17. A tool for characterizing an earth formation surrounding a borehole having a borehole wall, the tool comprising:
- an elongated body adapted for downhole operation in the borehole; and
- a probe body, moveable out of and back into the elongated body, the probe body defining a flow line,
- wherein said probe body includes
  - a pressure sensor for measuring fluid pressure in said flow line, a piston, and an electrical motor actuator that is adapted to move said piston in order to vary volume of said flow line,
  - a barrel, said piston being movable within said barrel and volume of said barrel vacated by movement of said piston being part of said flow line, a housing that is rigidly coupled to said barrel, wherein said housing encloses and supports said electrical motor actuator, at least one sealing member that surrounds said barrel, the at least one sealing member adapted to seal to the borehole wall during operation of the tool, a shoe that supports said at least one sealing member, said shoe mechanically coupled to said housing and said barrel, and a coupling between said shoe and said housing that allows for movement of said housing and barrel relative to said shoe.

18. A tool according to claim 17, wherein:

said coupling comprises a hydraulic accumulator.

19. A tool according to claim 17, wherein:

said coupling comprises a spring element that pushes said housing and barrel forward relative to said shoe.

20. A tool according to claim 19, wherein:

said piston translates along a central axis of said barrel, and said spring element provides a spring bias that pushes said housing and barrel forward relative to said shoe in a direction parallel to the central axis of said barrel.

21. A method for using the tool according to claim 1 to characterize an earth formation surrounding a borehole having a borehole wall, the method comprising:

a) providing the tool, wherein the probe body includes a barrel, a piston moveable in the barrel whereby volume of said barrel vacated by movement of the piston is part of the flow line, a pressure sensor for measuring fluid pressure in the flow line, a housing, and a shoe supporting at least one sealing member that surrounds the barrel, wherein the barrel is rigidly coupled to the housing and the shoe is coupled to housing in a manner that allows for movement of the housing and barrel relative to the shoe, and wherein the housing encloses and supports an electrical motor actuator that is adapted to move the piston in the barrel in order to vary volume of the flow line;

b) with the sealing member and the barrel of the probe body in a configuration wherein a distal end portion of the barrel extends away from the elongated body beyond the sealing member, moving the probe body away from the elongated body such that the distal end portion of the barrel is at or near contact with the borehole wall;

c) subsequent to b), moving the shoe of the probe body toward the borehole wall to compress the sealing member to form a seal between the sealing member and the borehole wall, wherein, during the operation of c), the distal end portion of the barrel is fixed in positioned at or near contact with the borehole wall;

d) subsequent to c), moving the piston to expand the volume of the flow line to allow for formation fluid to enter into the flow line; and e) subsequent to d), measuring pressure in the flow line with the pressure sensor in order to characterize the formation.

22. A method according to claim 21, wherein:

a spring element provides a spring bias that pushes the barrel forward relative to the shoe during the operation of c).

23. A method according to claim 21, wherein:

the probe body includes a ratchet mechanism that allows for limited movement of the piston in the barrel in a direction away from the borehole wall during the operations of b).

24. A method according to claim 21, further comprising:

deriving a measure of formation pressure based upon the pressure measured in e).

25. A method according to claim 21, further comprising:

deriving a measure of formation mobility based upon the pressure measured in e).

26. A method according to claim 21, wherein:

the piston has an aperture extending into an interior bore, wherein the interior bore is part of the flow line.

27. A method according to claim 26, wherein:

the pressure sensor is mounted to the piston with access to the interior bore of the piston.

28. A method according to claim 21, wherein:

the borehole wall is lined with a mud cake seal;

the output of pressure sensor is used to detect an occurrence of a break in the mud cake seal while the volume of the flow line is expanded in d); and upon detecting the occurrence of a break in the mud cake seal, maintaining the piston in a stationary position in the flow line in order to hold constant the volume of the flow line for a sufficient build-up period to establish pressure equilibrium between the flow line and formation fluid.

29. A method according to claim 28, wherein:

the occurrence of a break in the mud cake seal is detected by identifying divergence in pressure in the flow line as compared to a reference tool pressure profile.

30. A method according to claim 28, wherein:

the occurrence of a break in the mud cake seal is detected by identifying an abrupt change in pressure in the flow line.

* * * * *